United States Patent [19]

Specktor

[11] 4,400,969

[45] Aug. 30, 1983

[54] APPARATUS FOR SECURING A VEHICLE TO BE STRAIGHTENED

[75] Inventor: Gerald A. Specktor, St. Paul, Minn.

[73] Assignee: Align-Tech, Inc., St. Paul, Minn.

[21] Appl. No.: 277,872

[22] Filed: Jun. 26, 1981

[51] Int. Cl.[3] ..... B21D 1/12

[52] U.S. Cl. ..... 72/457; 72/705; 269/71; 269/78; 269/203; 269/900

[58] Field of Search ..... 72/457, 461, 705; 410/111, 116; 248/503, 507; 269/71, 77, 78, 203, 900

[56] References Cited

U.S. PATENT DOCUMENTS

| | | | |
|---|---|---|---|
| 1,785,923 | 12/1930 | Wade | 72/705 X |
| 2,451,307 | 10/1948 | South | 72/705 X |
| 2,459,080 | 1/1949 | Killius | 269/71 |
| 2,463,966 | 3/1949 | Hauschild | 72/705 |
| 2,823,567 | 2/1958 | Pothier | 269/71 |
| 3,276,237 | 10/1966 | Transue | 72/295 |
| 3,338,086 | 8/1967 | Hunter | 72/705 |
| 3,351,356 | 11/1967 | Clark et al. | 410/116 |
| 3,495,795 | 2/1970 | Brown | 269/71 |
| 3,631,705 | 1/1972 | McCaffrey | 72/705 |
| 3,696,653 | 10/1972 | Mojelski | 72/705 |
| 3,888,100 | 6/1975 | Chisum | 72/305 |
| 4,138,877 | 2/1979 | Specktor | 72/461 |
| 4,151,737 | 5/1979 | Specktor | 72/457 |
| 4,246,686 | 1/1981 | Specktor | 72/416 |
| 4,248,079 | 2/1981 | Specktor | 72/465 |
| 4,263,802 | 4/1981 | Specktor | 72/457 |
| 4,271,692 | 6/1981 | Specktor | 72/447 |
| 4,337,636 | 7/1982 | Clausen | 72/705 |
| 4,344,314 | 8/1982 | Aldrich et al. | 72/705 |

FOREIGN PATENT DOCUMENTS

| | | | |
|---|---|---|---|
| 2227849 | 12/1973 | Fed. Rep. of Germany | 72/705 X |

OTHER PUBLICATIONS

E.Z-Lines; pp. 4 and 9, Nov. 1, 1980.

*Primary Examiner*—Lowell A. Larson
*Attorney, Agent, or Firm*—Kinney, Lange, Braddock, Westman and Fairbairn

[57] ABSTRACT

An apparatus secures a damaged vehicle for straightening with a vehicle straightening device. The apparatus includes a base and a mechanism for securely attaching the base to a support in a plurality of positions such that the base is in a fixed spatial relationship with respect to the vehicle straightening device in each position and is easily transferable from position to position. A clamping mechanism securely holds the vehicle by clamping a portion of the vehicle. A vertical positioning mechanism positions the clamping mechanism along a substantially vertical axis between the base and the vehicle portion to be clamped and a preferred horizontal positioning mechanism positions the clamping mechanism along a substantially horizontal plane. The clamping mechanism is pivotable about two separate pivot axes located between the base and the clamping mechanism. The clamping mechanism is positionable for clamping any portion of the vehicle in a continuum of spatial positions and securely holds the vehicle for straightening with the vehicle straightening device.

9 Claims, 8 Drawing Figures

APPARATUS FOR SECURING A VEHICLE TO BE STRAIGHTENED

BACKGROUND OF THE INVENTION

1. Field of the Invention

The present invention relates generally to apparatus used to secure a damaged vehicle against the pulling or pushing forces of a car straightening device.

2. Description of the Prior Art

In the vehicle straightening field, there are various types of apparatus that secure damaged vehicles for straightening with a vehicle straightening device. Typically, the damaged vehicle is secured in a fixed position in relation to the straightening device and the straightening device is used to apply a combination of pulling and pushing forces against the damaged vehicle's sections, straightening the vehicle. However, the available apparatus for securing the vehicle have limitations and deficiencies in securing the vehicle in a proper and economically, efficient manner.

The prior art securing apparatus require considerable time and effort by repair personnel to secure the damaged vehicle from moving in any direction during the straightening process. In addition, when the damaged vehicle is required to be raised off its suspension for straightening work, the prior art apparatus are inadequate to securely hold the damaged vehicle in the raised position during the straightening process. Further, a variety of peripheral equipment has been used with the prior art apparatus to help in securing the damaged vehicle during straightening. Such items as wood blocks, chains and hooks are used in helping to secure the damaged vehicle. Oftentimes, the above types of peripheral equipment cause further damage to the car during the straightening process.

Several prior art patents describe some of the various methods that have been used to secure a vehicle within a straightening device. The Wade U.S. Pat. No. 1,785,923 secures a vehicle at one end by attching a chain to the frame of the vehicle. At the other end, a clevis is attached to the frame of the car and is secured to a support with a pair of rods and a turnbuckle in between. The turnbuckle is turned, placing a tension force on the car frame.

The South U.S. Pat. No. 2,451,307 shows a clamp that is clamped to the vehicle frame by two bolts and is attached to a fixed support by a strain bar. A strain bar is attached to the clamp by a pivot pin allowing the clamp to be pivoted in position for clamping on to the vehicle frame.

The Transue U.S. Pat. No. 3,276,237 shows a clamp that bolts to the frame of a car and is pivotally attached to a section of the car straightening device. The clamp pivots vertically about the two horizontal pivot axes. However, the clamping device of the Transue patent is not suitable for clamping unibody vehicles and the vehicle must be positioned in a precise manner along a vertical plane formed by the two pivot axes so that the clamp can be clamped to the car frame.

The Chisum U.S. Pat. No. 3,888,100 shows a clamping device that clamps to the body of a car and is attached to a fixed support by a chain securing the car in position. However, the use of a chain does not allow the vehicle to be secured when raised off its suspension and requires a considerable amount of time and effort to thoroughly secure the vehicle.

The Specktor U.S. Pat. No. 4,138,877 and 4,246,686, which were issued to the applicant of the present application, describe an apparatus that includes a clamp that clamps on to the body of a car and is secured to a support by a chain. The support can be positioned in a plurality of positions on the car straightening device using a single rotatable attaching member that engages an underside of track members of a vehicle straightening device.

A further method of securing a car within a straightening device is also described in the Specktor U.S. Pat. No. 4,151,737, which was also issued to the applicant of the present application. A Bolster extends through apertures of a track member of the car straightening device and extends upwardly to abut a portion of the vehicle frame thereby anchoring the vehicle to the car straightening apparatus.

SUMMARY OF THE INVENTION

The present invention includes apparatus for securing a damaged vehicle during the straightening of the vehicle by a straightening device. The apparatus for securing the vehicle includes a detachable base and a mechanism for securely attaching the base to a support in a plurality of positions with respect to the damaged vehicle and in a fixed spatial relationship with respect to the vehicle straightening device. A clamping mechanism securely holds the vehicle to be straightened by clamping a vehicle portion. A first positioning mechanism positions the clamping mechanism along a substantially vertical axis and pivots the clamping mechanism about a first substantially vertical pivot axis proximate the base and a second positioning mechanism pivots the clamping mechanism about a second substantially vertical pivot axis and preferably positions the clamping mechanism along a substantially horizontal plane. The clamping mechanism of the apparatus of the present invention is positioned for clamping the vehicle in a continuum of spatial positions with respect to the damaged vehicle.

The present invention provides an apparatus for securing a damaged vehicle of any shape or size once the vehicle is positioned within the straightening device. The apparatus is placed proximate the damaged vehicle and secured to the support by the securing mechanism at an appropriate position on the support. The clamping mechanism is positioned preferably on the under side of an appropriate section of the vehicle, such as a pinch weld. The clamping mechanism, being pivotal about two axes and movable in both substantially vertical and horizontal directions, is positionable to any clamping position. Once the damaged vehicle has been placed within the straightening device, the vehicle need not be moved in any direction to be secured by the present invention. In addition, the present invention will secure a damaged vehicle in either a raised position off a support surface or in a position on the support surface.

DETAILED DESCRIPTION OF THE PREFERRED EMBODIMENT

Figure 1:
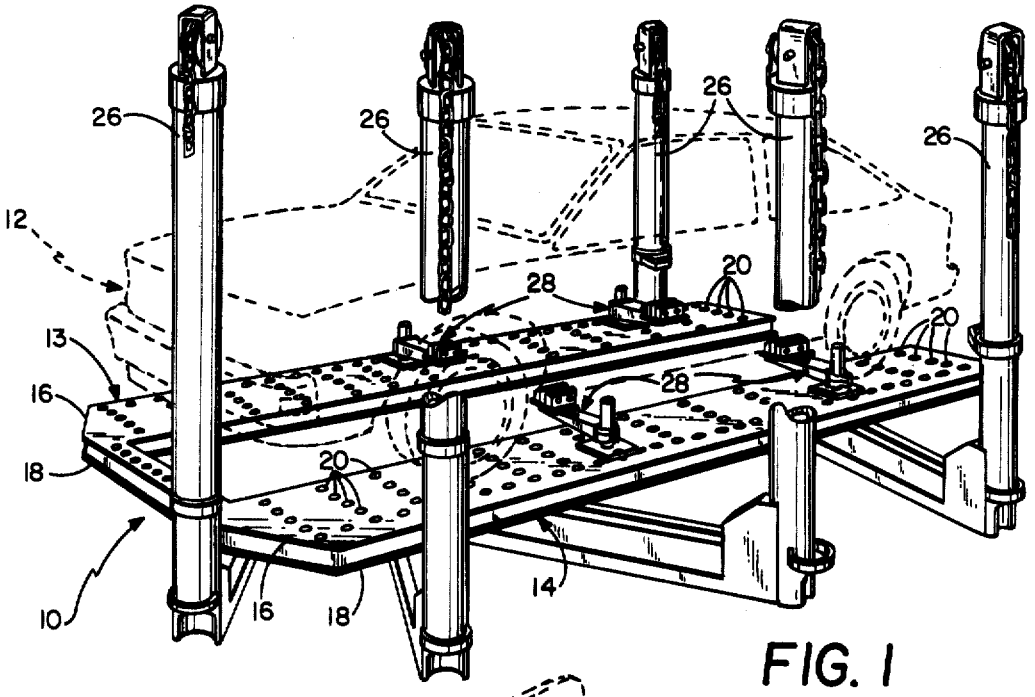
FIG. 1 is a perspective view of a damaged vehicle within a vehicle straightening device and the preferred apparatus securing the damaged vehicle to the straightening device.
Figure 2:
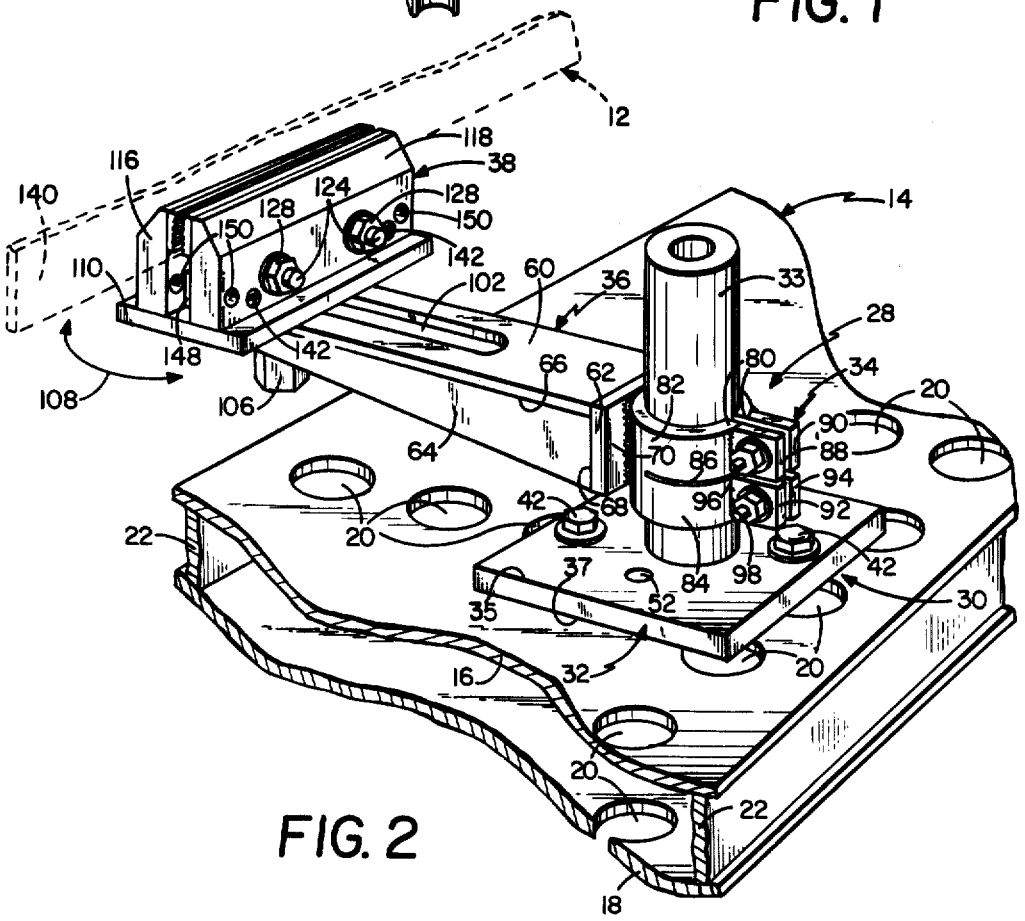
FIG. 2 is an enlarged perspective view of the apparatus of the present invention.
Figure 3:
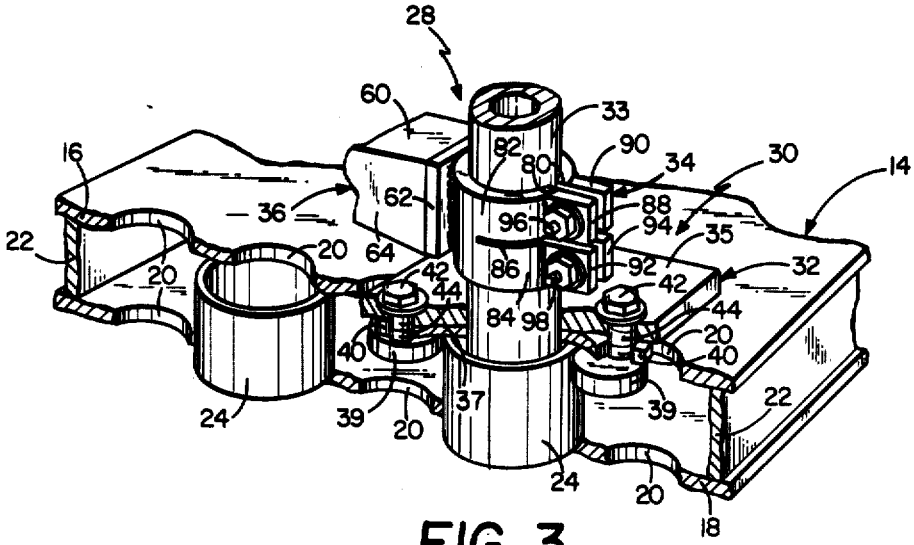
FIG. 3 is a perspective view of the apparatus illustrating the manner of securing the apparatus to the vehicle straightening device with portions broken away for purposes of clarity.

A vehicle straightening device is generally indicated at 10 in FIG. 1. A preferred structure of the vehicle straightening device is described in the patent issued to the same applicant of the present invention entitled "Apparatus for Repairing and Straightening," U.S. Pat. No. 4,151,737, issued on May 1, 1979. A vehicle 12 is typically driven onto left and right tracks 13, 14. The left and right tracks 13 and 14 includes a top plate 16 and a bottom plate 18, with a plurality of apertures 20, as shown in FIGS. 1 and 2. The top and bottom plates 16, 18 are spaced from each other and are connected by substantially upright members 22 and spacer stop members 24 as illustrated in FIGS. 2 and 3. Preferably, the spacer stop members 24 are cylindrical but any suitable configuration is within the scope of the invention. A plurality of pull towers 26 are used to straighten the damaged vehicle 12, applying forces against the vehicle body such that the vehicle is straightened, as illustrated in FIG. 1. It should be understood that the present invention is not limited to the apparatus for straightening and repairing cars as described in U.S. Pat. No. 4,151,737 but is designed to be used with any compatible vehicle straightening device.

A preferred apparatus for securing a damaged vehicle to be straightened is generally indicated at 28, in FIGS. 2 through 5. The apparatus of the present invention includes a base member 30, a substantially upright member 33, a substantially circular bracket 34, a support arm 36 and a clamping mechanism 38 which will be discussed in detail below.

Figure 5:
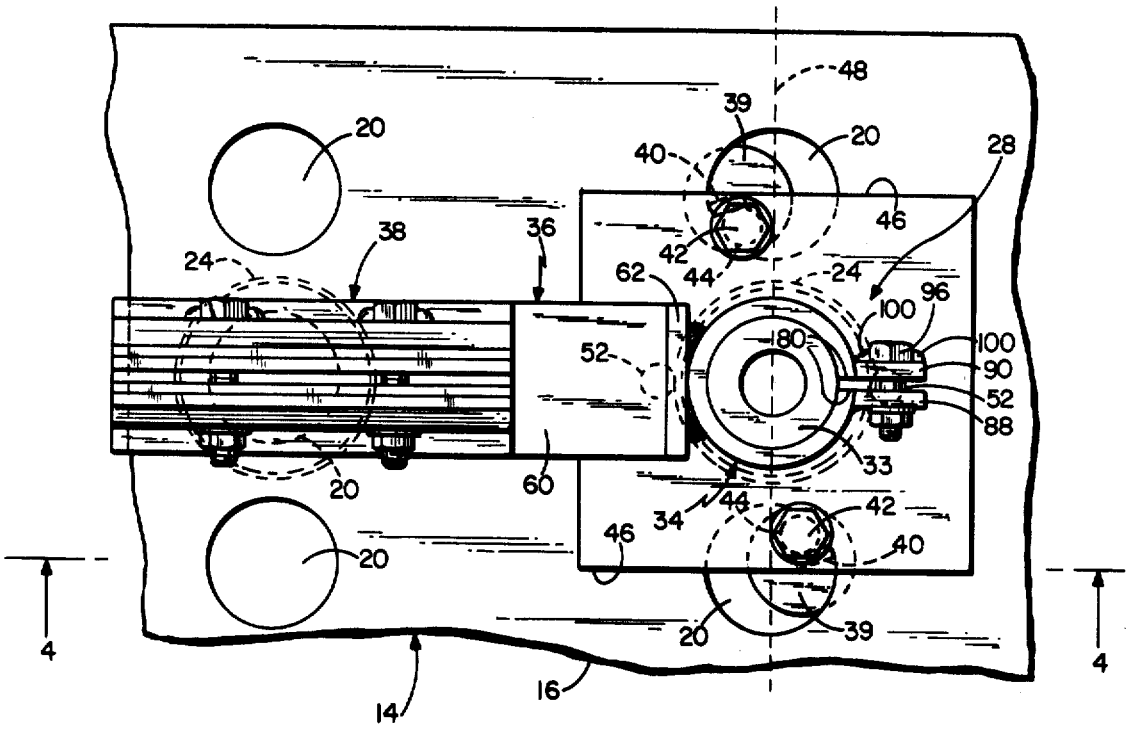
FIG. 5 is a top view of the apparatus.

The base member 30 attaches the apparatus 28 in a fixed spatial relationship with respect to the vehicle straightening device in a plurality of positions and has a base plate 32 with a top surface 35 and a bottom surface 37. A pair of spaced apart discs 39 are positioned beneath the base plate 32 and each disc 39 is spaced vertically therefrom a thickness of the top plate 16 by a spacer 40 as shown in FIG. 3. The spacer 40 is fixedly attached to the bottom surface 37, such as by welding. Each disc 39 is eccentrically connected to the base plate with a bolt 42 which extends through an aperture 44 in the base plate 32. Preferably, the apertures 44 are positioned proximate opposite edges 46 of the base plate 32 and are positioned on opposite sides of a center line 48 defined by a series of apertures 20 in the track 13 or 14, as illustrated in FIG. 5.

The base member 30 is preferably attached to a track of the vehicle straightening device, as shown in FIGS. 2 through 5. Although the base member 30 is shown attached to the right track 14, it will be understood that the base member may be attached to any track such as the left track, a front track, rear track or any support within the proximity of the damaged vehicle including a receptical in a floor.

The discs 39 are preferably spaced from each other such that the discs are insertable within every second aperture 20. The base 30 is secured to the top plate 16 by turning the base plate 32 until the spacers 40 engage surfaces of the apertures 20, as illustrated in FIG. 5. The bolts 42 are then turned, rotating the discs such that a portion of the disc is rotated to beneath a bottom surface of the top plate 16, as illustrated in FIG. 3. The discs 39, when rotated, engage the stop members 24, preventing further movement of the discs, as shown in FIG. 3. The bolts 42 are turned further moving the discs 39 clamping upwardly the base plate 32 to the top plate 16 of the track. The spacers 40 help retain the discs 39 substantially parallel to the base plate 32 in the clamped position.

Although the discs 39 are shown as cylindrical in shape, the discs can be square or rectangular and can extend through rectangular or square holes in the top plate 16. In addition, the discs, as shown in the figures, can also be placed into square or rectangular holes which are sufficient in size for the discs 39 to be placed therethrough.

Figure 6:
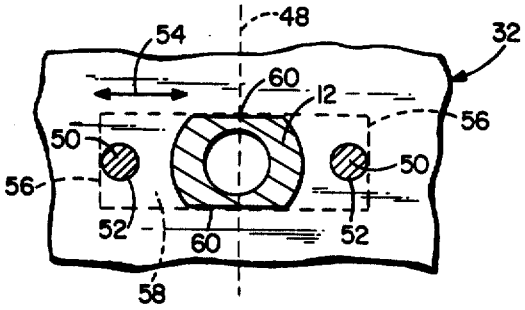
FIG. 6 is a top cross-sectional view of an alternative embodiment illustrating the engagement of a rectangular aperture in a track of the vehicle straightening device.

When the discs are placed through rectangular holes, a pair of pins 50 are provided for insertion through apertures 52 in the base plate 32 which lie along a line substantially perpendicular to the center line 48, as illustrated in FIG. 6. The pins 50 prevent the base plate 32 from sliding on the top plate 16 in the direction of arrow 54 by engaging spaced apart edges 56 of the rectangular apertures 58.

If the top plate 16 has a plurality of narrow slots running the length of the track, the discs 39 can be in the shape of oblong slugs which are sufficiently narrow for insertion through the slots. The slugs are rotated transversely to the longitudinal direction of the slots by turning the bolts as described above and engage vertical supports which act as stops.

The upright member 33 is positioned between the discs 39 and is fixedly attached to the base plate 32. Preferably, the upright member 33 extends below the base plate 32 and through an aperture 20 in the track, when the base member 30 is attached to the top plate 16. In the alternative embodiment illustrated in FIG. 6, the upright 33 has shaved sides 60, below plate 32 that engage corresponding sides of the rectangular aperture 58 preventing rotation of unit 30. When the track has narrow slots, the upright member 33 does not extend below the base plate 32.

Figure 4:
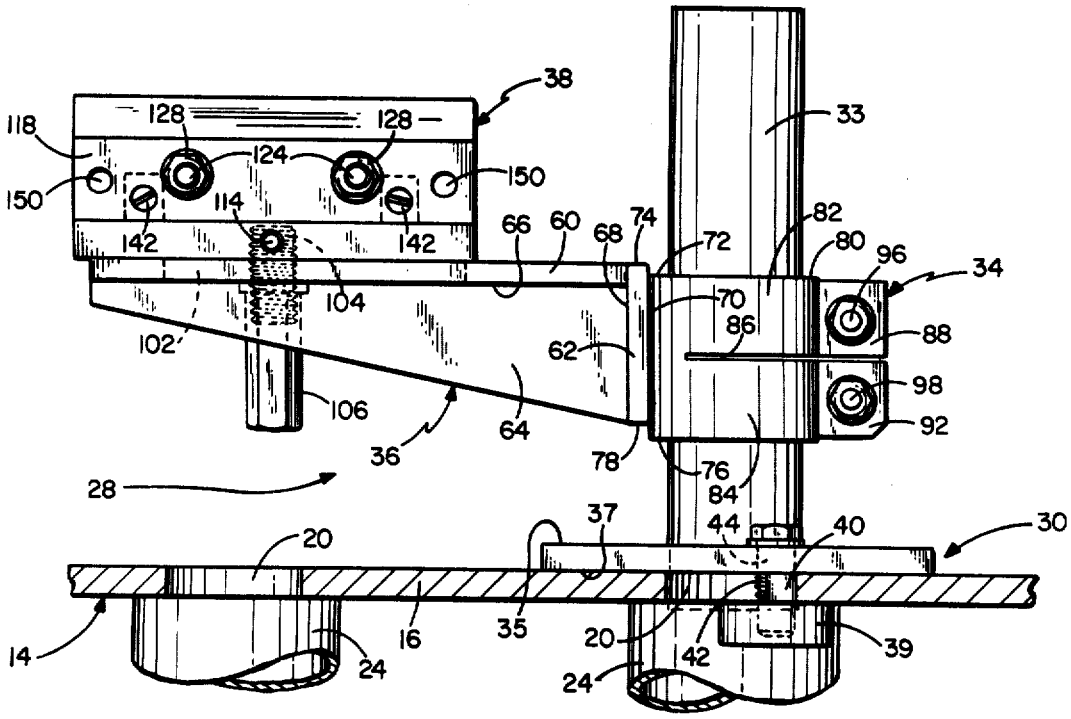
FIG. 4 is a side elevational view of the apparatus of the present invention, taken along the line 4—4 in FIG. 5

The support arm 36 includes a top substantially horizontal plate 60, a substantially vertical end plate 62 welded to one end of the plate 60, and a pair of gussets 64 welded to a bottom surface 66 of the plate 60 and to a front surface 68 of the end plate 62, as illustrated in FIGS. 2 and 4. The top plate 60, the end plate 62 and the gussets 68 form a rigid support arm capable of withstanding strong forces.

The support arm 36 is slidably and pivotally attached to the upright member 33 by the circular bracket 34. The circular bracket 34 circumferentially surrounds the upright member 33 and is attached to the support arm 36 by suitable means, such as welding to surface 70 of the end plate 62. Preferably, a top surface 72 of the circular bracket 34 is positioned below a top surface 74 of the end plate 62 and a bottom surface 76 of the circular bracket 34 is below a bottom surface 78 of the end plate 62 as shown in FIG. 4. The circular bracket 34 is welded to the end plate 62 such that the top plate 60 is substantially horizontal.

The circular bracket 34 has ends 80 horizontally spaced-apart as shown in FIG. 5, and an upper half 82 and a lower half 84 having a slot 86 partially spacing the two halves vertically apart, as shown in FIG. 4. The bracket 34 also includes upper left and right tabs 88, 90 fixedly attached proximate the ends 80 to the upper half 82 and extending outwardly therefrom. Lower left and right tabs 92, 94 are similarly attached to the ends 80 of the lower half 84 and extend outwardly therefrom in approximately the same corresponding planes as the upper left and right tabs 88, 90, respectively. The tabs 88, 90 and 92, 94 are suitably attached to the ends of the circular brackets such as by welding. The upper left and right tabs 88, 90 each have aligned apertures with a bolt 96 extending therethrough threadably fastened by a nut. Similarly, a second bolt 98 extends through aligned apertures in the lower left and right tabs 92, 84 threadably fastened by a nut.

The circular bracket 34 has an inside diameter slightly greater than the outside diameter of the upright 33 when the bolts 96, 98 are not tightened. When the bolts 96, 98 are in an untightened position, support arm 36 is pivotal substantially horizontally and slidable in a substantially vertical direction along the upright member 33. When the bolts 96, 98 are tightened, the tabs are drawn together and the bracket 34 is drawn against the upright member 33, securing the support arm in both a fixed vertical position and a fixed first pivotal horizontal position. In this manner, the support arm 36 is positioned at any vertical level and pivoted to any horizontal angle desired.

The bolts 96, 98 have heads that engage stops 100, as illustrated in FIG. 5. The stops 100 keep the bolts 96, 98 from turning when the nuts are turned to tighten the bolts.

Referring back to FIG. 2, the clamping mechanism 38 is attached to a free end portion of the support arm 36. Preferably, the support arm 36 has a substantially horizontal slot 102 proximate the free end portion and extending longitudinally along the top plate 60. A threaded rod 104 is attached at its upper end to the clamping mechanism 38 and extends through slot 102 and is threadably engaged by a coupler nut 106, as shown in FIG. 6. The clamping mechanism 38, when the coupler nut 106 is in an untightened position, is slidable over the top surface of the top plate 60 along the slot 102 and can be pivoted to any horizontal angle desired, as indicated by arrow 108 in FIG. 2.

The clamping mechanism 38 includes a base plate 110, preferably of a rectangular configuration having substantially parallel flat top and bottom surfaces and substantially parallel edges. The base plate includes a threaded hole 112 wherein the threaded rod 104 is fixedly attached to the base plate 110, preferably by welding. Alternatively, the threaded rod 104 is attached to the base plate 110 by a roll pin 114 positioned through aligned apertures within both the base plate 110 and the rod 104, as illustrated in FIGS. 7 and 8.

A fixed upright jaw 116 is preferably welded to the top of the base plate 110 in a substantially fixed upright position. A movable jaw 118 in a substantially parallel upright position is slidable on the top surface of the base plate 110 in the direction of arrow 120. The jaws 116 and 118 have a plurality of substantially horizontal passages 122, preferably two, spaced apart and preferably extending through both jaws. Bolts 124 extend through the aligned passages 122 and are threadably engaged by nuts 128 and have heads 126. Bolt stops 130 are attached to the surface of the fixed jaw 116 proximate the bolt heads 126 to prevent the bolts from turning when the nuts 128 are turned to tighten the jaws of the clamping device. The jaw 118, when the nuts are turned, moves substantially parallel to the fixed jaw 116.

Clamping portions 132 and 134 are fixedly attached to the jaws 116, 118, respectively. The clamping portions 132 and 134 have serrated edges 136, 138, respectively, for gripping a portion 140 of the vehicle, especially a pinch weld of a unibody vehicle, when the jaws are moved together as illustrated in FIGS. 2 and 7.

Figure 7:
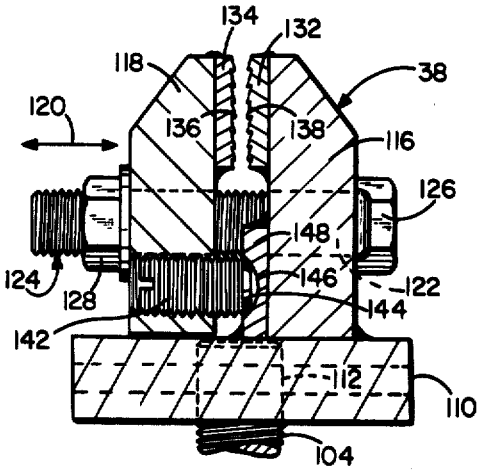
FIG. 7 is a cross-sectional view of the clamping mechanism of the apparatus of the present invention taken along the line 7—7 in FIG. 8.
Figure 8:
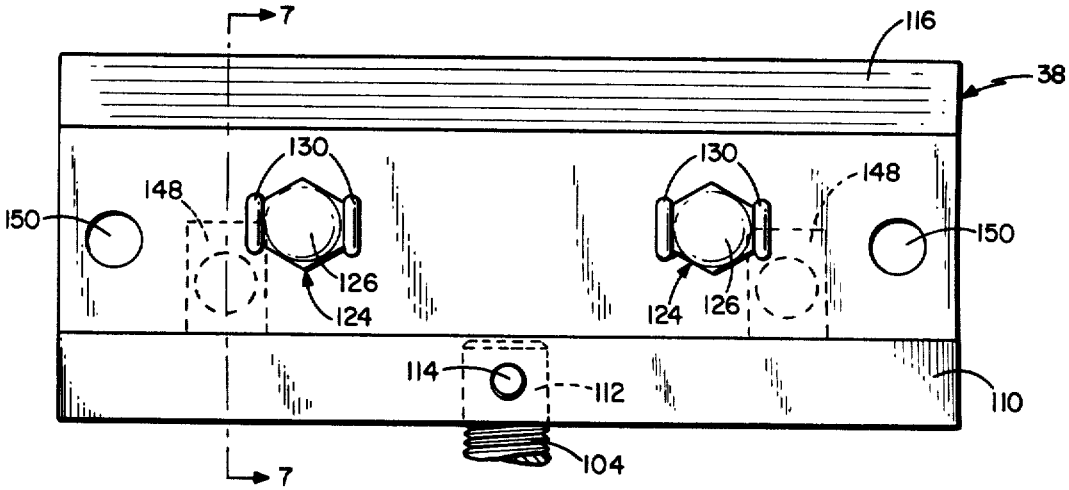
FIG. 8 is a side elevational view of one side of the clamping mechanism.

To ensure the jaws 116, 118 are in substantially parallel position when they are tightened and to adjust the clamp for various thick masses of vehicle portions, a set screw 142 is positioned proximately below the bolts 124 in threaded apertures in the movable jaw 118 as illustrated in FIGS. 2 and 7. The set screw 142 engages the fixed jaw 116 with a distal end 144. Preferably, the set screw 142 engages a depression 146 in a shoulder portion 148 welded on an inward side of the fixed jaw 118. The set screw 142 is used to position the jaw 118 in a substantially parallel relationship to the fixed jaw 116 and to help maintain the jaw 118 in a stable clamping position.

Passages 150 extend through both the fixed jaw 116 and the movable jaw 118 and receive pins (not shown) that extend through a link of a chain (not shown) positioned between the jaws when the clamping mechanism is used in a non-clamping manner. In addition, passages 150 can be used to receive bolts (not shown) to secure rigid members (not shown) that connect two or more apparatus 28 together to provide a more secure holding of the damaged vehicle.

In operation, the damaged vehicle is placed within a straightening device. The apparatus 28 for securing the vehicle is then positioned proximate the vehicle at strategic points such as the front left and the front right sides and the rear left and the rear right sides of vehicle pinchweld. Each apparatus 28 is attached to the tracks of the straightening device by placing the discs through appropriate apertures 20 within the left and right tracks of the car straightening device. The base plate 32 is then rotated slightly until the spacers 40 hit the edges of the apertures 20, as shown in FIG. 5. An edge portion of each disc is positioned beneath the top plate and when the bolts ae turned, the discs rotate eccentrically until they engage the stop members 24, as shown in FIG. 3. The bolts 42 are then turned until the base plate 32 is firmly secured on to the top plate 16.

The circular bracket, in an untightened position, is pivoted about the upright member 33 to horizontally position the support arm 36 and the clamping mechanism 38 beneath the appropriate section of the damaged vehicle. The circular bracket is then slid upwardly along the upright member 33 until the jaws 116 and 118 are on opposite sides of a portion of the damaged vehicle, preferably a pinch weld. The nuts 128 are tightened, moving the jaw 118 towards the fixed jaw 116 and securely clamping the portion of the vehicle. The jaws 116 and 118 are adjusted to close and clamp on vehicle portions in a wide range of thicknesses in a parallel manner by adjusting set screws 142. The set screws additionally help prevent jaw 118 from moving once the clamping mechanism is in the clamped position.

During clamping, the clamping mechanism 38 is free to move along the slot 102 to ensure that the vehicle portion has been properly clamped. After the vehicle portion has been clamped, the coupler nut 106 is tightened, firmly securing the clamping mechanism 38 to the support arm 36. The nuts on bolts 96 and 98 are tightened, securing arm 36 to upright member 33.

CONCLUSION

The apparatus of the present invention firmly secures the vehicle from movement in any direction within a vehicle straightening device in a continuum of spatial positions. The apparatus is easily placed proximate the damaged vehicle at any point along the straightening device and is easily transferred from position to position. The clamping mechanism of the present invention is pivotal about the two axes and is movable in a substantially vertical direction and a substantially horizontal direction, permitting the clamping mechanism to be positioned along any point of the damaged vehicle securing the vehicle without the use of any accessory or peripheral equipment. The clamping mechanism secures a vehicle in both a raised position or in a normal position with the vehicle on the support.

Although the present invention has been described with reference to the preferred embodiments, a person skilled in the art will recognize that changes may be made in the form and detail without departing from the spirit and scope of the present invention.

What is claimed is:

1. An apparatus for securing a vehicle to be straightened with a vehicle straightening device and attached to a horizontal support, the apparatus comprising:

a detachable base;

means for securely attaching the base to the support in a fixed spatial relationship with respect to the vehicle straightening device in any of a plurality of positions;

clamping means for securely holding the vehicle to be straightened by clamping a vehicle portion, the clamping means including:

a base plate;

a fixed jaw permanently attached to an upper surface of the base plate;

a movable jaw slidably movable along the top surface of the base plate with respect to the fixed jaw, the movable jaw having a plurality of threaded apertures and further comprising a plurality of set screws positioned in the threaded apertures and threadably extending through the movable jaw with distal ends engaging the fixed jaw such that the movable jaw is adjustable to a substantially parallel position with respect to the fixed jaw by threadably moving the set screws against the fixed jaw; and a plurality of threaded fasteners above the threaded apertures extending through both the movable and the fixed jaw such that the movable jaw is placed in a clamping position clamping a vehicle portion by tightening the threaded fasteners;

first positioning means attached to said detachable base for pivotally positioning the clamping means about a first substantially vertical axis and for positioning the clamping means in a substantially vertical direction; and second positioning means for pivotally positioning the clamping means about a second substantially vertical axis spaced from the first vertical axis such that the clamping means is positionable about the second vertical axis for clamping the vehicle portion in a continuum of spatial positions.

2. The apparatus of claim 1 wherein the second positioning means includes positioning the clamping means in a substantially horizontal direction.

3. The device of claim 1 wherein the first positioning means comprises:

a substantially upright rigid member fixedly attached at a bottom end to the base;

a bracket engaging an outer surface of the substantially upright member slidably movable in a substantially vertical direction and slidably pivotal about an axis of the upright member; and means for fixedly securing the bracket in fixed vertical and pivotal positions.

4. The apparatus of claim 3 wherein the second positioning means comprises:

a substantially horizontal rigid support arm having a first end attached to the bracket and a second end with a substantially horizontal slot therethrough;

a threaded rod fixedly attached at an upper end portion thereof to the clamping means and extending through the slot and having a threaded lower end portion below the slot; and a nut threadably engaging the lower end portion of the rod such that the clamping means pivots about the second vertical axis in the slot and is movable in a substantially horizontal direction along the slot and the nut secures the clamping means from movement by engaging a lower surface of the support arm.

5. The apparatus of claim 1 wherein the means for securely attaching the base includes a plurality of rotatable members and a plurality of threaded rods attached to and rotatably extending through the base and threadably attached to the rotatable members at a lower end such that when the members are placed with appropriate apertures in the support and the threaded rods are turned, the members rotate to a position at least partially beneath the support and move upwardly on further turning of the rods to securely engage the base against the support.

6. The device of claim 5 wherein the support includes stop means on an under side of the support and the rotatable members eccentrically attach to the threaded rods such that when the rods are turned the rotatable members engage the stops, stopping in a position with a substantial portion of the rotatable member under the support and when the rods are turned the rotatable members moves threadably upwardly along the rods securing the base against the support.

7. An apparatus for securing a vehicle to be straightened in combination with a vehicle straightening device having a substantially horizontal support with a top surface and a bottom surface and a plurality of apertures, the apparatus comprising:

a detachable base attached to the support proximate the apertures;

means for securely attaching the detachable base to the support in a plurality of positions the means for securely attaching the base including a plurality of rotatable members and a plurality of threaded rods attached to and rotatably extending through the base and threadably attached at a lower end to the rotatable members at an eccentric position with respect to the axis of the rotatable member so that the rotatable members when placed within appropriate apertures in the support rotate to a position at least partially beneath the support and move upwardly on further turning of the rods to securely engage the base against the support and wherein the support includes stop means on an underside of the support position to engage the rotatable members in a position with a substantial portion of the rotatable member under the support, the rotatable members being forced threadably upward along the rods securing the base against the support;

clamping means for securely holding the vehicle to be straightened by clamping a portion of the vehicle;

vertical positioning means attached to said base for positioning the clamping means in a substantially vertical direction from the base;

horizontal positioning means for positioning the clamping means in a substantially horizontal direction from the base:

a substantially rigid horizontal member connecting the vertical positioning means and the horizontal positioning means and having a first end and a second free end and being positionable in a vertical direction above the detachable base;

first pivot means for pivoting the rigid member about a first vertical pivot axis above the base said horizontal member rigidly attached to the first pivot means at the first end;

a second pivot means for pivoting the clamping means proximate the second free end of the rigid member about a second vertical pivot axis such that the clamping means is positionable for clamping the portion of the vehicle in a continuum of spatial positions.

8. An apparatus for securing a vehicle to be straightened with a vehicle straightening device and attached to a horizontal support, the apparatus comprising:

a base;

means for securely attaching the base to the horizontal support;

clamping means for securely holding the vehicle to be straightened;

first positioning means for pivotally positioning the clamping means about a first substantially vertical and for positioning the clamping means in a substantially vertical direction, the first positioning means including a rigid substantially vertical support attached to the base at a lower end and a bracket surrounding the vertical support and being positionable in a pivotal and a stationary position, the bracket having discrete upper and lower frictionally engaging halves and upper and lower means for positioning the upper and lower halves, respectively, between a pivotal and a stationary position such that the first positioning means is securely held in a stationary position during straightening of the vehicle;

second positioning means for pivotally positioning the clamping means about a second substantially vertical axis spaced from the first vertical axis such that the clamping means is pivotable about the second vertical axis and positionable in a substantially horizontal direction for clamping the vehicle portion in a continuum of spatial positions; and a rigid support having a first end and a second end, the first end being fixedly attached to the bracket and the second end supporting the clamping means and the second positioning means.

9. The apparatus of claim 8 wherein the vertical support has a height sufficient to allow the clamping means to secure a vehicle in a raised position.

* * * * *